US009035187B2

(12) United States Patent
Pons et al.

(10) Patent No.: US 9,035,187 B2
(45) Date of Patent: May 19, 2015

(54) CABLES COMPRISING REMOVABLE INDICATOR STRIPS, AND METHODS AND MACHINES FOR MANUFACTURING THE CABLES

(75) Inventors: Jean-Louis Pons, Sens (FR); Jean Barbedette, Sens (FR); Thierry Jorand, Sens (FR); Dominique Bastide, Sens (FR); Serge Colombier, Sens (FR)

(73) Assignee: PRYSMIAN CABLES ET SYSTEMES FRANCE, Paron (FR)

( * ) Notice: Subject to any disclaimer, the term of this patent is extended or adjusted under 35 U.S.C. 154(b) by 358 days.

(21) Appl. No.: 13/700,310

(22) PCT Filed: May 27, 2011

(86) PCT No.: PCT/EP2011/058752

§ 371 (c)(1), (2), (4) Date: Apr. 17, 2013

(87) PCT Pub. No.: WO2011/147973

PCT Pub. Date: Dec. 1, 2011

(65) Prior Publication Data

US 2013/0240240 A1 Sep. 19, 2013

(30) Foreign Application Priority Data

May 28, 2010 (FR) ..... 10 54146

(51) Int. Cl.

*H01B 13/34* (2006.01)
*H01B 7/36* (2006.01)
*H01B 13/14* (2006.01)

(52) U.S. Cl.

CPC ..... *H01B 7/36* (2013.01); *H01B 7/366* (2013.01); *H01B 13/143* (2013.01); *H01B 13/342* (2013.01); *H01B 13/34* (2013.01)

(58) Field of Classification Search

USPC ..... 174/112; 29/825, 745

See application file for complete search history.

(56) References Cited

U.S. PATENT DOCUMENTS

| | | | | |
|---|---|---|---|---|
| 2,521,123 | A * | 9/1950 | Lawrence | 425/113 |
| 4,658,089 | A * | 4/1987 | Guzy et al. | 174/113 R |
| 4,911,525 | A * | 3/1990 | Hicks et al. | 385/114 |

(Continued)

FOREIGN PATENT DOCUMENTS

| | | | |
|---|---|---|---|
| CN | 101546625 B | * | 11/2011 |
| JP | 6-076646 A | | 3/1994 |

OTHER PUBLICATIONS

International Search Report PCT/ISA/210 for International Application No. PCT/EP2011/058752 dated Aug. 22, 2011.

*Primary Examiner* — Timothy Thompson
*Assistant Examiner* — Charles Pizzuto
(74) *Attorney, Agent, or Firm* — Harness, Dickey & Pierce, PLC

(57) ABSTRACT

A cable (100) is proposed, comprising a protective sheath (130) wherein at least one conductor is housed. The protective sheath has a given thickness and an external diameter within a range of values defined by a predetermined standard. The cable also comprises at least one removable indicator strip (150): that extends longitudinally over at least one arc portion of the external circumferential surface of the protective sheath; that is made of a material enabling said at least one removable indicator strip to adhere to the protective sheath, while being capable of being detached from the protective sheath without altering it, by applying an extraction force per unit of width of said at least one removable indicator strip greater than a predetermined threshold; that has a thickness so that the external diameter of the protective sheath increased by the thickness of said at least one removable indicator strip is within said range of values.

18 Claims, 3 Drawing Sheets

(56) References Cited

Figure 1A:
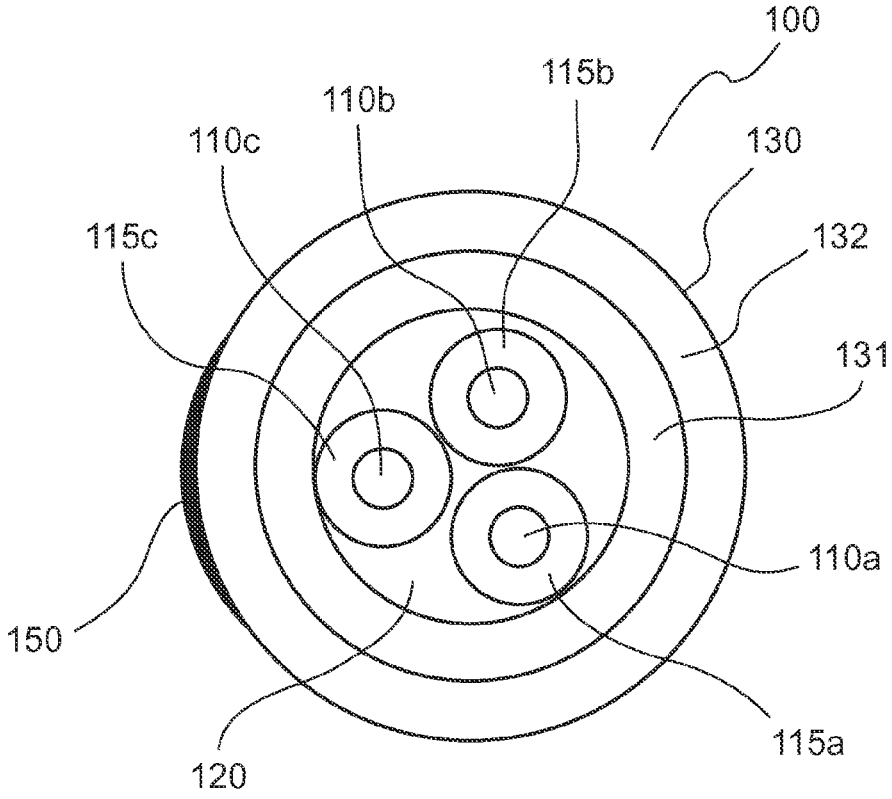

U.S. PATENT DOCUMENTS 5,281,764 A * 1/1994 King et al. ..... 174/112
5,409,653 A * 4/1995 Malm ..... 264/146
6,037,545 A * 3/2000 Fox et al. ..... 174/110 R
6,463,198 B1 * 10/2002 Coleman et al. ..... 385/101
8,168,093 B2 * 5/2012 Alrutz ..... 264/1.28
2002/0129966 A1 * 9/2002 Schneider et al. ..... 174/112
2002/0185299 A1 * 12/2002 Giebel ..... 174/110 R
2008/0273844 A1 * 11/2008 Kewitsch ..... 385/101

* cited by examiner

CABLES COMPRISING REMOVABLE INDICATOR STRIPS, AND METHODS AND MACHINES FOR MANUFACTURING THE CABLES

CROSS-REFERENCE TO RELATED APPLICATION(S)

This application is a national stage entry from International Application No. PCT/EP2011/058752, filed on May 27, 2011, in the Receiving Office of the European Patent Office, which claims priority from French Patent Application No. 1054146, filed on May 28, 2010, in the French Patent Office, the entire contents of both of which are incorporated herein by reference.

FIELD OF THE INVENTION

The field of the invention is that of the design and manufacture of cables such as, for example, electrical or optical cables.

More specifically, the invention relates to a cable comprising a protective sheath wherein at least one conductor is housed and a method for manufacturing such a cable.

The invention has numerous applications in the field of cables, such as, for example, telecommunications, transport and power distribution.

TECHNOLOGICAL BACKGROUND

This document will more specifically describe the problem in the field of electrical cables, with which the inventors of this patent application have been faced. The invention is of course not limited to this particular field of application, and is of interest for any type of cable involving a similar problem (for example, optical cables).

Traditionally, an electrical cable comprises a protective sheath wherein one or more electrical conductor(s) is (are) housed. This protective sheath is intended to ensure the isolation of electrical conductors from the external environment.

There are currently a very wide variety of cables that have been developed to respond to a wide range of applications, which must be capable of being easily identified.

The need to visually distinguish one cable from another among a plurality of cables is therefore a problem with which the manufacturers and users of cables are commonly faced.

For this reason, numerous identification systems (or indicators), such as, for example, identification by labeling, by a writing field or by a color code, have been envisaged so as to facilitate the identification of cables. Usually, the cables are marked in relief or with ink on their external sheath.

Various techniques for identification by color code are known from the prior art.

For example, a known technique, presented in patent document GB 260,837, consists of permanently attaching a colored polymer or plastic indicator strip on one or more arc portions of the external surface of the protective sheath of an electrical cable. The color of the colored plastic or polymer indicator strip is assigned according to characteristics of the cable.

Another known technique presented in patent document U.S. Pat. No. 2,521,123 (Western Electric) is based on a manufacturing technique by sheath extrusion of the protective sheath of an electrical cable consisting of forming, during the extrusion phase, an indicator strip made of a colored polymer material, at the protective sheath.

The IrisTech™ technique, developed by the Prysmian company and described for example in the brochure entitled "Cabo Eprotenax Gsette® EPR 0.1/1 kV" is also known. This technique consists of producing, by sheath extrusion, a cable of which the protective sheath comprises a longitudinal indicator strip, which constitutes a portion of the surface of the sheath of the cable. The strip is part of the protective sheath and therefore cannot be detached (unless excessive force is used and unless the circular cross-section of the cable is altered). The strip has a light color different from that (generally black) of the rest of the surface of the protective sheath. The strip is such that, on top of it, a user can write (with a pencil of the type used to write on CDs) information useful for the installation or subsequent maintenance of the electrical assembly wherein said cable is used. Owing to a predetermined color code, the color of the strip indicates the electrical cross-section of the cable (for example, a distinct color for each cross-section possible between 1.5 and 25 $mm^2$).

None of the known techniques mentioned above proposes that the indicator strip (colored strip) can be detached from the protective sheath. Indeed, according to the known techniques, the indicator strip is permanently and irremovably attached to the protective sheath, so that the removal of this indicator strip would cause a deformation, and even tearing of the protective sheath, causing an irremediable alteration of the protective sheath and, in particular, a change in the external diameter of the sheath. The cable therefore would no longer have a circular cross-section and would very likely be non-standard.

However, the fact that the indicator strip is permanently and irremovably attached to the protective sheath has disadvantages:

if the user wants to change or remove the initial identification of a cable, provided by the indicator strip, it is not possible. For example, the user may want to use an identification of the cables only during the installation phase of the cables;

the use of a permanent and irremovable indicator strip is not possible for all cables because, in certain countries, there is a single required sheath color (for example, standard NF C 32-321 requires an entirely black sheath).

OBJECTIVES OF THE INVENTION

The invention, in at least one embodiment, is intended in particular to overcome these various disadvantages of the prior art.

More specifically, in at least one embodiment of the invention, an objective is to provide a technique making it possible to modify (change or remove) an initial identification of a cable, without causing any deformation or alteration of the protective sheath of said cable.

Another objective of at least one embodiment of the invention is to provide a technique capable of being applied to all cable types, including those requiring a single sheath color.

At least one embodiment of the invention is also intended to provide such a technique that makes it possible to maintain an external diameter of the protective sheath within a standardized range of values, as well as a minimal thickness value for the protective sheath.

An additional objective of at least one embodiment of the invention is to provide such a technique that makes it possible to provide a surface state of the identification system suitable for writing.

Yet another objective of at least one embodiment of the invention is to provide a technique that is based only on means traditionally used for the manufacture of cables in an industrial environment, i.e. a technique that is easy and inexpensive to implement.

DESCRIPTION OF THE INVENTION

In the present description and the appended set of claims, unless otherwise indicated, all of the numbers expressing amounts, percentages or the like, must be understood as being modified at any time by the term "around". In addition, all of the value ranges include all of the combinations including minimum and maximum values, and also include any intermediate range (whether or not they are mentioned below) between these minimum and maximum values.

A particular embodiment of the invention proposes a cable comprising a protective sheath wherein at least one conductor is housed, said protective sheath having a given thickness and an external diameter within a range of values defined by a predetermined standard. The cable also comprises at least one removable indicator strip:

that extends longitudinally over at least one arc portion of the external circumferential surface of the protective sheath;

that is made of a material enabling said at least one removable indicator strip to adhere to the protective sheath, while being capable of being detached from the protective sheath without altering it, by applying an extraction force per unit of width of said at least one removable indicator strip greater than a predetermined threshold;

that has a thickness so that the external diameter of the protective sheath increased by the thickness of said at least one removable indicator strip is within said range of values.

The general principle of a particular embodiment of the invention therefore consists of creating, on at least a portion of the external circumferential surface of a protective sheath of a cable, one or more removable indicator strip(s), each having a level of adhesion to the protective sheath so that it can be detached from the protective sheath (manually, for example) without altering the geometric structure of the latter. In other words, unlike the known solutions mentioned above, the indicator strip(s) can be removed without tearing the protective sheath (such a tearing causes, in the known solutions, an irremediable alteration of the protective sheath and, in particular, a change in the external diameter of the sheath).

Once the indicator strip(s) removed from the protective sheath, the cable can therefore have a use other than that initially intended, as it has preserved its geometric and mechanical characteristics. Indeed, as the indicator strip(s) are created with an added thickness with respect to the protective sheath (in other words, each indicator strip does not penetrate the protective sheath) and have a level of adhesion to the protective sheath enabling it to be easily removed, such a removal does not produce any defect or alteration of the external circumferential surface of the protective sheath and the cable preserves its usual circular appearance.

Moreover, the thickness of each indicator strip is very low and such that the presence of the indicator strip on the protective sheath does not produce an unwanted protuberance on the external portion of the cable. The invention indeed involves compliance with the tolerance limit imposed on the external diameter of the cable. The invention also proposes that the protective sheath have, when it is not covered with one or more indicator strips, a minimum thickness (generally imposed by a standard). Thus, in the presence or in the absence (after removal) of the indicator strip(s), the geometric characteristics of the cable remain compliant with the standards imposed (for both the external diameter of the cable and for its minimum thickness).

Also, because the indicator strip(s) can be detached from the protective sheath, this technique can be applied to all cable types, including those requiring a single sheath color. Indeed, the indicator strip(s) of the invention can be detached and are not part of the cable (unlike the indicator strips of the known solutions mentioned above). Therefore, if a cable complies with a standard requiring a single sheath color (for example, an entirely black sheath in the case of standard NF C 32-321), the presence of one or more detachable colored strip(s) at the surface of said cable does not change the fact that the cable complies with this standard.

Preferably, said at least one removable indicator strip consists of a polymer material co-extruded with the protective sheath.

Such a technique is simple and inexpensive to implement since it requires not adhesive, but, advantageously, means for co-extrusion of the removable indicator strip(s), which cooperate with means traditionally used for manufacture of the cable by sheath extrusion on an extrusion line.

In an alternative embodiment, the means for adhesion of the removable indicator strip(s) on the protective sheath can be constituted by the addition of an adhesive adapted for compliance with the aforementioned conditions (level of adhesion to the protective sheath so that the strip can be detached from the protective sheath without altering it). This alternative, although it can be achieved, is of little benefit from an industrial perspective (during the manufacturing method, it requires slowing down, complications and an increased cost).

Advantageously, the predetermined threshold is between 0.1 and 10 N/mm, and preferably between 0.1 and 5 N/mm.

Such threshold enable sufficient adhesion of the indicator strip on the protective sheath while being capable of being easily detached from it without modifying the mechanical and geometric characteristics thereof. Indeed, it is important to emphasize that, while being detachable when necessary, the indicator strip must remain firmly attached to the protective sheath during storage, deployment and use of the cable (these operations involving mechanical and thermal constraints).

Advantageously, said at least one removable indicator strip has a thickness of between 5 and 15% of the thickness of the protective sheath.

Advantageously, said at least one removable indicator strip 150 has a thickness of between 0.1 and 0.3 mm.

According to an advantageous feature, when the sheath is made of polyvinyl chloride, said at least one removable indicator strip consists of a mixture in a proportion of between 30/70 and 60/40, and preferably between 40/60 and 55/45, of high-density polyethylene (HDPE) and ethylene vinyl acetate.

Advantageously, the ethylene vinyl acetate contains at least 15%, and preferably at least 20% by weight of vinyl acetate.

In a particular embodiment, the cable comprises at least two removable indicator strips.

According to another embodiment, a method for manufacturing a cable comprising a protective sheath wherein at least one conductor is housed, said protective sheath having a given thickness and an external diameter within a range of values defined by a predetermined standard, the method comprising a step wherein the protective sheath and at least one removable indicator strip are co-extruded, wherein said at least one removable indicator strip:

extends over at least one arc portion of the external circumferential surface of the protective sheath;

is made of a material enabling said at least one removable indicator strip to adhere to the protective sheath, while being capable of being detached from the protective sheath without altering it, by applying an extraction force per unit of width of said at least one removable indicator strip greater than a predetermined threshold;

has a thickness so that the external diameter of the protective sheath increased by the thickness of said at least one removable indicator strip is within said range of values.

According to yet another embodiment, a machine is proposed for the manufacture of a cable comprising a protective sheath wherein at least one conductor is housed, the machine comprising at least one extruder cooperating with an extrusion die for forming said protective sheath having a given thickness and an external diameter within a range of values defined by a predetermined standard. Said machine also comprises at least one additional extruder cooperating with the extrusion die so as to form, by co-extrusion, a removable indicator strip that extends longitudinally over at least one arc portion of the external circumferential surface of the protective sheath.

LIST OF THE FIGURES

Figure 1B:
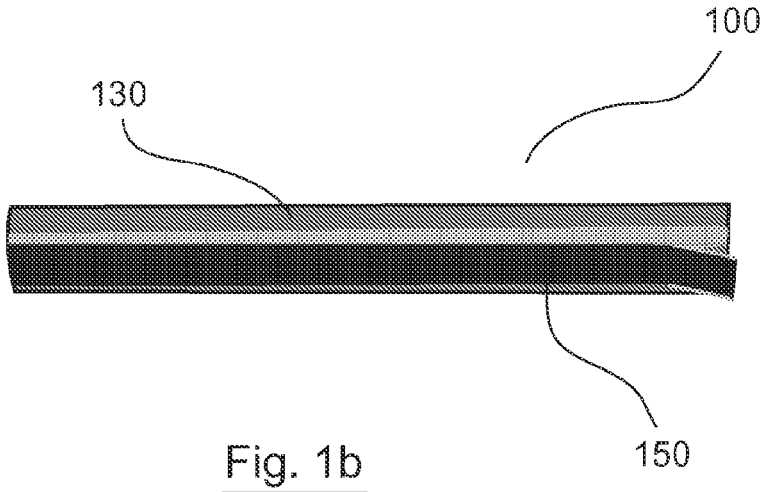

Other features and advantages of the invention will appear in the following description, provided as an indicative and non-limiting example, and the appended drawings, wherein:

FIG. 1*a* shows a transverse cross-section view of a cable with three electrical conductors obtained according to a particular embodiment of the invention;

FIG. 1*b* shows a top view of the cable with three electrical conductors shown in FIG. 1*a;*

Figure 2:
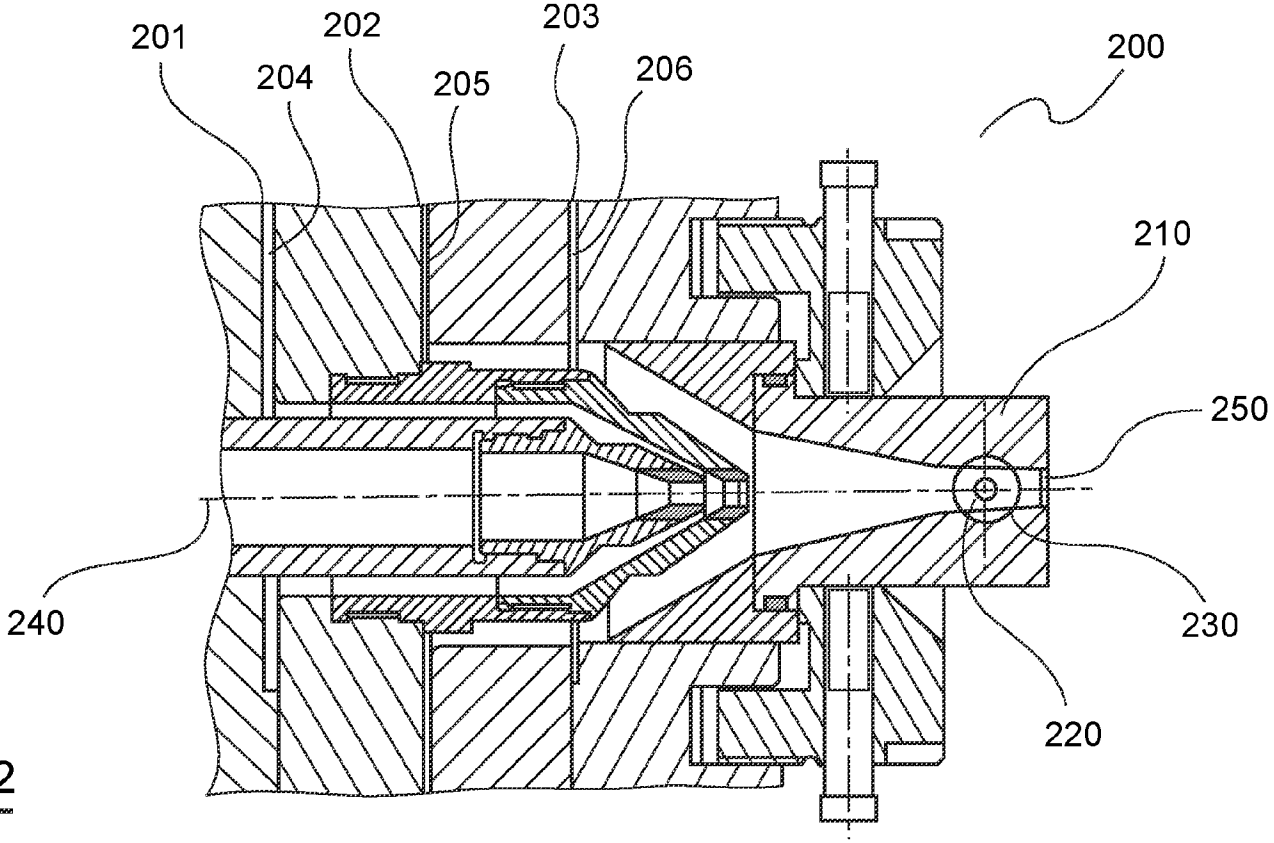
Figure 3B:
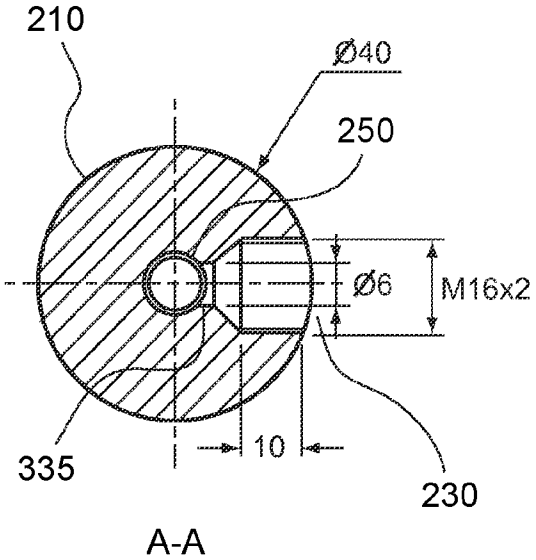
Figure 3A:
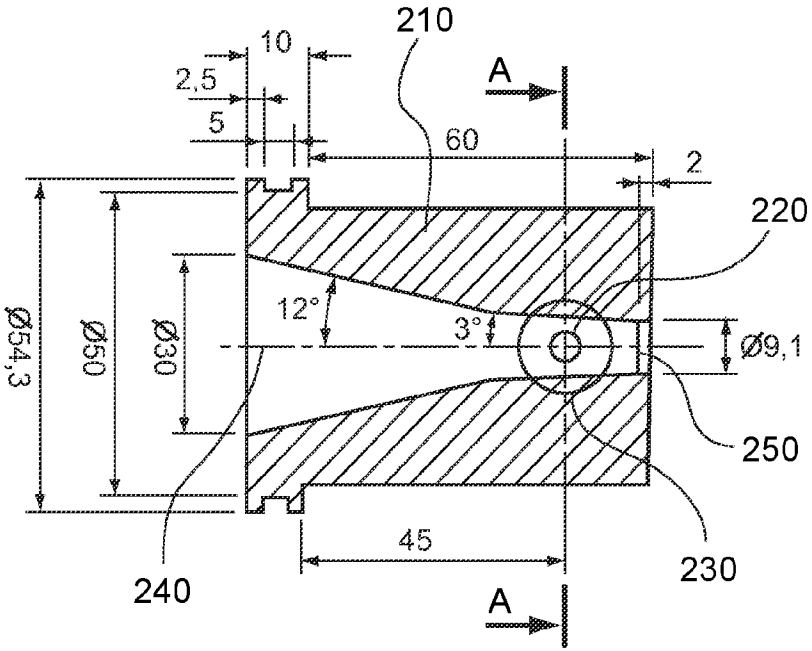

FIG. 2 shows a schematic diagram of an extrusion device for the manufacture of a cable with three electrical conductors according to a particular embodiment of the invention;

FIG. 3*a* shows an embodiment of the extrusion die and the additional extruder in the device of FIG. 2;

FIG. 3*b* shows a cross-section view of the extrusion die and the additional extruder according to the axis A-A of FIG. 3*a*.

DETAILED DESCRIPTION

In all of the figures of this document, the same elements and steps are designated by the same numeric reference.

FIG. 1*a* schematically shows a transverse cross-section view of a cable 100 with three electrical conductors obtained according to a particular embodiment of the invention.

The electrical cable 100 more specifically consists of the following elements:

a set of three electrical conductors 110*a*, 110*b*, 110*c*, each surrounded by a layer of insulating material 115*a*, 115*b* and 115*c;* a filler layer 120 surrounding all three electrical conductor layers 110*a* to 110*c;* a protective sheath 130, surrounding the filler layer 120 and comprising a first internal layer 131 and a second external layer 132 enabling the electrical conductors 110*a* to 110*c* to be housed.

As an illustrative example, for a cable of type "R2V3G 1.5 $mm^2$" as defined in the French standard NF C 32-321, the internal 131 and external 132 layers of the sheath 130 are respectively made of a PVC-based material and the filler layer is made of a PVC-based filler material.

The internal 131 and external 132 layers of the protective sheath 130 can be made of the same material or of different materials selected, for example, from polyvinyl chloride (PVC), polyethylene, ethylene vinyl acetate, etc. In certain embodiments, the protective sheath 130 can be made with a single layer.

In addition, the electrical cable 100 comprises, in this particular embodiment of the present invention, a removable indicator strip 150 arranged longitudinally over a portion of the external circumferential surface of the protective sheath 130. The indicator strip 150 is made of a polymer material of which the level of adhesion with the material of the external layer 132 of the protective sheath 130 enables the indicator strip 150 to adhere to the protective sheath 130, while being capable of being detached from the protective sheath 130 without it being altered by such a detachment (or removal).

Advantageously, the polymer material is chosen so that the indicator strip 150 can be extracted by applying an extraction force per unit of width of the strip greater than a threshold of between 0.1 and 10 N/mm (preferably between 0.1 and 5 N/mm). This threshold makes it possible to set the level of adhesion of the indicator strip 150 so that:

the indicator strip 150 adheres sufficiently to the protective sheath so as to prevent any undesired detachment of the indicator strip, for example during storage or handling of the electrical cable, or during use of the cable (at a given operating temperature); and the indicator strip 150 can be removed from the protective sheath relatively easily, preferably by detachment or pulling or preferably by peeling by hand, without damaging the external surface of the protective sheath.

According to this invention, the indicator strip 150 must also have a material thickness so that the external diameter of the protective sheath increased by this material thickness is within a range of values defined according to the standards in force.

A cable of type "R2V3G 1.5 $mm^2$" for example, of which the diameter is 9.1 mm, can include an indicator strip 150 with a thickness of between 0.1 and 0.3 mm, which makes it possible to comply with the range of values allowed by standard NF C 32-321.

In this way, in spite of the addition of an additional thickness (due to the presence of the indicator strip 150 at the external surface of the protective sheath 130), the dimensions of the cable 100 (diameter and circularity) remain compliant with the standard imposed.

This invention gives the user the possibility of simply and easily removing the indicator strip 150 from the cable 100 in order to use the cable 100 for a use other than that for which it was initially intended, without adversely affecting the geometric and mechanical characteristics. In other words, in spite of the removal of the indicator strip 150 from the protective sheath 130, the cable preserves its initial dimensions (diameter and circularity).

Thus, the external diameter of the electrical cable 100 remains within the range of values allowed by the standard in force (for example, standard NF C32-321), whether or not the indicator strip 150 has been detached from the protective sheath 130.

The indicator strip 150 has, for example, a thickness of between 5 and 15% of the thickness of the protective sheath 130. Thus, for a protective sheath thickness of between 1.6 and 1.8 mm, the indicator strip has, for example, a thickness of between 0.1 and 0.3 mm.

In a particular embodiment, the indicator strip 150 has a strip width and a surface state suitable for writing. For example, for an "R2V3G 1.5 $mm^2$" cable, the indicator strip 150 has a width of between 4 and 5 millimeters, which enables a user to write directly on the cable 100 any information that might be considered useful.

If the protective sheath 130 is made of polyvinyl chloride, the indicator strip 150 can be made with a mixture of polymers comprising polyethylene (preferably high-density polyethylene) and a polar polymer (For example, ethylene vinyl acetate containing at least 15% by weight of vinyl acetate, and preferably at least 20%, and for example up to 30%). The polyethylene/polar polymer ratio of this mixture is, for example, between 30/70 and 60/40, and preferably between 40/60 and 55/45.

It should be noted that a person skilled in the art will adapt the material to be used for the removable indicator strip 150 based on the material(s) of the protective sheath 130, so as to comply with the aforementioned conditions (the strip must adhere sufficiently to the sheath but must be capable of being removable without altering the sheath, as its diameter must remain within the standardized value range).

It should be noted that the cable shown in FIG. 1*a*, as well as in all of the figures described below, comprises only one removable indicator strip 150. It is clear that many other embodiments of the invention may be envisaged. It is possible in particular to provide a cable comprising a plurality of removable indicator strips, without going beyond the scope of the invention.

FIG. 1*b* shows a top view of the cable with three electrical conductors 100 presented above in reference to FIG. 1*a*.

In this particular embodiment, a removable indicator strip 150 is arranged longitudinally over a portion of the external circumferential surface of the protective sheath 130. In FIG. 1*b*, a portion of the indicator strip 150, located on the right-hand portion of the cable 100, is slightly detached from the sheath 130.

A schematic diagram of an extrusion device 200 for the manufacture of a cable 100 with three electrical conductors according to a particular embodiment of the invention will now be presented in reference to FIG. 2.

The extrusion device 200 comprises a traditional sheath extrusion portion, enabling the electrical conductors 110*a* to 110*c* to be covered with a sheath comprising one or more layers of polymer materials, so as to insulate them from the external environment.

This traditional portion of the extrusion device 200 comprises a set of three extruders, referenced 201, 202 and 203 in FIG. 2, each being intended to heat and to separately obtain a molten polymer material flowing via a distinct distribution channel 204, 205, 206. The three molten polymer materials flow simultaneously in the form of a stratified flow and are pushed through an extrusion die 210 (of which the principle is sufficiently described below in reference to FIG. 3*a*) enabling an electrical cable 100 covered with three polymer layers to be obtained. The extruder 201 makes it possible to form the filler layer 120, the extruder 202 and the internal layer 131 of the protective sheath 130, and the extruder 203 and the external layer 132 of the protective sheath 130 of the electrical cable 100 of FIG. 1. The extrusion die 210 comprises a first circular discharge orifice 250 located longitudinally with respect to the extrusion axis 240, suitable for the extrusion of the three layers 120, 131, 132 of the protective sheath 130.

The extrusion device 200 also comprises an additional extruder 230 of which the objective is to cooperate with the extrusion die 210 to form, by co-extrusion, a removable indicator strip 150 at the surface of the protective sheath 130. This removable indicator strip extends longitudinally over an arch portion of the external circumferential surface of the protective sheath 130.

Thus, the removable indicator strip 150 and the three layers 120, 131, 132 of the protective sheath 130 are co-extruded (i.e. simultaneously extruded) by the extrusion die 210.

The extrusion die 210 also comprises a second circular orifice 220, located perpendicularly to the extrusion axis 240, through which the additional extruder 230 provides the material necessary for forming, by co-extrusion, the removable indicator strip 150 at the surface of the protective sheath 130.

FIGS. 3*a* and 3*b* show an example of a structure of the extrusion die 210 and the additional extruder 220 comprised in the device of FIG. 2, according to a particular embodiment of the invention, with FIG. 3*a* showing a side view and FIG. 3*b* showing a cross-section view according to the axis A-A of FIG. 3*a*.

The extrusion die 210 comprises a first circular orifice 250 located longitudinally with respect to the extrusion axis 240, of which the size makes it possible to define the external diameter of the protective sheath 130. In FIG. 3*a*, the diameter of the orifice 250 corresponds to the diameter of 9.1 mm complying with standard NF C 32-321 for a cable of type "R2V3G 1.5 $mm^2$".

The extrusion die 210 also comprises a second circular orifice 220, placed at an angle of 90° with respect to the extrusion axis 240, of which the size makes it possible to define the width of the removable indicator strip 150 co-extruded on the surface of the protective sheath 130 and to cooperate with the head 335 of the additional extruder 230. In the figure, the width of the removable strip 150 is equal to 6 mm. The diameter of the orifice 220 formed in the extrusion die 210 corresponds to the diameter of the head 335 of the additional extruder 230.

Other embodiments of the extrusion die 210 can be envisaged without going beyond the scope of this invention. In general, the additional extruder has a size sufficient to ensure the flow of material constituting the strip, at industrial production speeds, and comprises an extrusion screw suitable for the material to be extruded.

The invention claimed is:

1. A cable, comprising:

at least one conductor;

a protective sheath housing the at least one conductor; and at least one removable indicator strip;

wherein the protective sheath has a thickness and external diameter within a range of values defined by a standard, wherein the at least one removable indicator strip extends longitudinally over at least one arc portion of an external circumferential surface of the protective sheath, wherein the at least one removable indicator strip is made of material enabling the at least one removable indicator strip to adhere to the protective sheath, while being capable of being detached from the protective sheath without altering the protective sheath, by applying an extraction force per unit width to the at least one removable indicator strip greater than a threshold of between 0.1 N/mm and 10 N/mm, and wherein the at least one removable indicator strip has a thickness of between 5% and 15% of the thickness of the protective sheath so that the external diameter of the protective sheath, increased by the thickness of the at least one removable indicator strip, is within the range of values defined by the standard.

2. The cable of claim 1, wherein the at least one removable indicator strip comprises a polymeric material co-extruded with the protective sheath.

3. The cable of claim 1, wherein the threshold is greater than or equal to 0.1 N/mm and less than or equal to 5 N/mm.

4. The cable of claim 1, wherein the at least one removable indicator strip has a thickness greater than or equal to 0.1 mm and less than or equal to 0.3 mm.

5. The cable of claim 1, wherein when the protective sheath is made of polyvinyl chloride, the at least one removable indicator strip consists of a mixture in a proportion of between 30/70 and 60/40 of high-density polyethylene (HDPE) and ethylene vinyl acetate.

6. The cable of claim 5, wherein when the protective sheath is made of polyvinyl chloride, the at least one removable indicator strip consists of a mixture in a proportion of between 40/60 and 55/45 of high-density polyethylene (HDPE) and ethylene vinyl acetate.

7. The cable of claim 5, wherein the ethylene vinyl acetate contains at least 15% by weight of vinyl acetate.

8. The cable of claim 5, wherein the ethylene vinyl acetate contains at least 20% by weight of vinyl acetate.

9. The cable of claim 1, wherein the cable comprises at least two removable indicator strips.

10. A method for manufacturing a cable that comprises at least one conductor, a protective sheath housing the at least one conductor, and at least one removable indicator strip, the protective sheath having a thickness and external diameter within a range of values defined by a standard, the method comprising:

co-extruding the protective sheath and the at least one removable indicator strip;

wherein the at least one removable indicator strip extends over at least one arc portion of an external circumferential surface of the protective sheath, wherein the at least one removable indicator strip is made of material enabling the at least one removable indicator strip to adhere to the protective sheath, while being capable of being detached from the protective sheath without altering the protective sheath, by applying an extraction force per unit width to the at least one removable indicator strip greater than a threshold of between 0.1 N/mm and 10 N/mm, and wherein the at least one removable indicator strip has a thickness of between 5% and 15% of the thickness of the protective sheath so that the external diameter of the protective sheath, increased by the thickness of the at least one removable indicator strip, is within the range of values defined by the standard.

11. A machine for manufacturing a cable that comprises at least one conductor, a protective sheath housing the at least one conductor, and at least one removable indicator strip, the machine comprising:

at least one extruder cooperating with an extrusion die to form the protective sheath having a thickness and external diameter within a range of values defined by a standard; and at least one additional extruder cooperating with the extrusion die so as to form, by co-extrusion, the at least one removable indicator strip;

wherein the at least one removable indicator strip extends longitudinally over at least one arc portion of an external circumferential surface of the protective sheath, wherein the at least one removable indicator strip is made of material enabling the at least one removable indicator strip to adhere to the protective sheath, while being capable of being detached from the protective sheath without altering the protective sheath, by applying an extraction force per unit width to the at least one removable indicator strip greater than a threshold of between 0.1 N/mm and 10 N/mm, and wherein the at least one removable indicator strip has a thickness of between 5% and 15% of the thickness of the protective sheath so that the external diameter of the protective sheath, increased by the thickness of the at least one removable indicator strip, is within the range of values defined by the standard.

12. The cable of claim 1, wherein the threshold of between 0.1 N/mm and 10 N/mm is predetermined.

13. The cable of claim 6, wherein the ethylene vinyl acetate contains at least 15% by weight of vinyl acetate.

14. The cable of claim 6, wherein the ethylene vinyl acetate contains at least 20% by weight of vinyl acetate.

15. The cable of claim 1, wherein when the protective sheath is made of polyvinyl chloride, the at least one removable indicator strip consists of a mixture of high-density polyethylene (HDPE) and ethylene vinyl acetate.

16. The cable of claim 1, wherein when the protective sheath is made of polyvinyl chloride, the at least one removable indicator strip comprises a mixture of high-density polyethylene (HDPE) and ethylene vinyl acetate.

17. The cable of claim 16, wherein the mixture of high-density polyethylene (HDPE) and ethylene vinyl acetate is in a proportion of between 30/70 and 60/40.

18. The cable of claim 16, wherein the mixture of high-density polyethylene (HDPE) and ethylene vinyl acetate is in a proportion of between 40/60 and 55/45.

* * * * *